US007462135B2

(12) United States Patent
Lo

(10) Patent No.: US 7,462,135 B2
(45) Date of Patent: Dec. 9, 2008

(54) ELLIPTICAL FITNESS MACHINE HAVING INCLINE ADJUSTING MECHANISM

(76) Inventor: Chiu-Hsiang Lo, No. 20, Lane 305, Sec. 3, Chung-Sun Rd., Tan-Tz Shiang, Taichung Hsien (TW)

( * ) Notice: Subject to any disclaimer, the term of this patent is extended or adjusted under 35 U.S.C. 154(b) by 215 days.

(21) Appl. No.: 11/312,777

(22) Filed: Dec. 21, 2005

(65) Prior Publication Data

US 2007/0060450 A1 Mar. 15, 2007

(30) Foreign Application Priority Data

Sep. 9, 2005 (TW) ..... 94215537 U

(51) Int. Cl.
*A63B 22/00* (2006.01)
*A63B 22/04* (2006.01)

(52) U.S. Cl. ..... 482/52; 482/57

(58) Field of Classification Search ..... 482/51, 482/52, 53, 57, 70, 79–80, 54
See application file for complete search history.

(56) References Cited

U.S. PATENT DOCUMENTS 5,423,729 A * 6/1995 Eschenbach ..... 482/70
5,989,159 A * 11/1999 Chen et al. ..... 482/52
6,135,927 A * 10/2000 Lo ..... 482/57
6,190,289 B1 * 2/2001 Pyles et al. ..... 482/52
6,939,271 B1 * 9/2005 Whan-Tong et al. ..... 482/52

* cited by examiner

*Primary Examiner*—Stephen R. Crow
(74) *Attorney, Agent, or Firm*—WPAT, P.C.; Anthony King

(57) ABSTRACT

A foldable elliptical fitness machine comprises a first frame, a second frame supported by the first frame, and an enabling assembly for enabling the second frame to rotate with respect to the first frame, the first frame securely supported on a floor and the second frame installed an elliptical structure, and the second frame is pivotally coupled to the first frame by a pivoting device, such that the second frame can be rotated with respect to the first frame, wherein the elliptical structure comprises a rotating member having two eccentric pivotal points, and two pedal arms. A central penetrating axle of the rotating member is pivotally coupled onto the second frame, and each eccentric pivotal point is pivotally coupled to the first end of the pedal arm, and each pedal arm includes a footrest for a user to step. If the first end of the pedal arm rotates with the crank, the footrest will move in an elliptic path. With the foregoing structural design, the elliptical structure of the invention has the functions of changing the inclination of the elliptical fitness machine so that users have the convenience of using by changing the level of difficulty of their exercise.

20 Claims, 14 Drawing Sheets

ELLIPTICAL FITNESS MACHINE HAVING INCLINE ADJUSTING MECHANISM

FIELD OF THE INVENTION

The present invention relates to a elliptical fitness machine having incline adjusting mechanism, and more particularly to an elliptical fitness machine structure that includes a first frame, a second frame and an enabling assembly, and wherein the second frame installed an elliptical mechanism, and the enabling assembly can actuate the second frame to rotate with respect to the first frame to achieve the purposes of changing the inclination of the elliptical fitness machine.

BACKGROUND OF THE INVENTION

In general, the basic structure of a prior art elliptical fitness machine includes a flywheel, two cranks, and two pedal arms, and a first end of each crank is coaxially connected to the flywheel, and a second end of each crank is pivotally connected to a first end of each corresponding pedal arm, and each pedal arm has a footrest, such that a user can step on the footrest. If the first end of the pedal arm rotates with the crank, the footrest will move in an elliptic path.

Since the elliptical fitness machine provides the function of a striding exercise, the elliptical fitness machine becomes one of the fitness equipments as popular as the treadmill. Traditional elliptical fitness machine does not come with a function of changing the inclination of the machine, and thus users cannot change the level of difficulty of their exercise by changing the inclination of the elliptical fitness machine. U.S. Pat. No. 6,146,313 disclosed a cross training exercise device, and the end of a pedal arm is connected to a guide track for adjusting the height and changing the exercise path of the pedal arm. However, the structure of this machine is not stable enough.

Furthermore, if the elliptical fitness machine and the treadmill are placed flatly on a floor for their use, the footprint of these fitness equipments occupy much area. To reduce the footprint of the fitness machines when the machines are not in use, some treadmills are designed to have a belt frame that can be folded upward, and it is not easy to design a foldable elliptical fitness machine because many mechanisms are disposed on the link rod, and the elliptical fitness machines are usually designed as a partial foldable structure. All of the present elliptical fitness machines do not come with a structure having a variable inclined body. For example, U.S. Pat. No. 6,149,551 only disclosed a foldable elliptical exercise machine that includes one frame, and the frame includes the main components such as a flywheel and a crank to operate with a pedal arm and the track is designed to have a free end which can be turned and folded upright with respect to a second frame. The elliptical exercise machine is partially folded, and the footprint is still large after the machine is folded.

SUMMARY OF THE INVENTION

The primary objective of the present invention is to provide an elliptical fitness machine having incline adjusting mechanism to improve the convenience of its use, and the elliptical fitness machine comprises a first frame, a second frame and an enabling assembly, wherein the first frame securely supported on a floor and the second frame installed an elliptical structure, and the second frame is pivotally coupled to the first frame by a pivoting device, such that the enabling assembly can actuate the second frame to be rotated with respect to the first frame to change the inclination of the elliptical fitness machine so that users can change the level of difficulty of their exercise, and wherein the elliptical structure comprises a rotating member having two eccentric pivotal points, and two pedal arms. A central penetrating axle of the rotating member is pivotally coupled onto the second frame, and each eccentric pivotal point of the rotating member is pivotally coupled to a first end of the corresponding pedal arm, and each pedal arm includes a footrest, such that a user can step on the footrest. If the first end of the pedal arm rotates with the crank, the footrest will move in an elliptic path. With the foregoing structural design, the elliptical structure of the invention has the functions of changing the inclination of the elliptical fitness machine so that users have the convenience of using by changing the level of difficulty of their exercise.

DETAILED DESCRIPTION OF THE PREFERRED EMBODIMENTS

Figure 1:
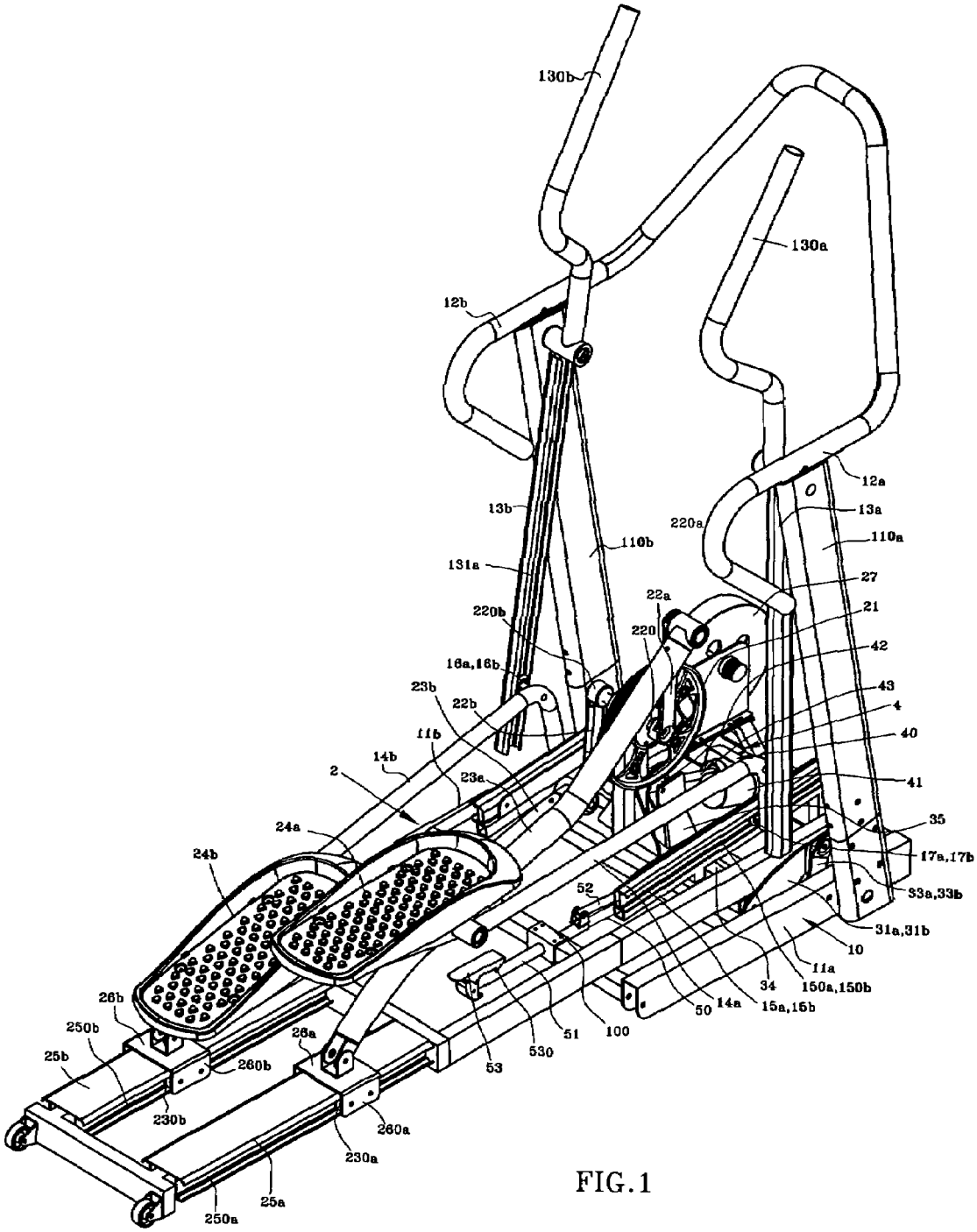
FIG. 1 is a schematic view of a basic structure and a structure having a smaller inclination and a usable status according to a first preferred embodiment of the present invention.
Figure 2:
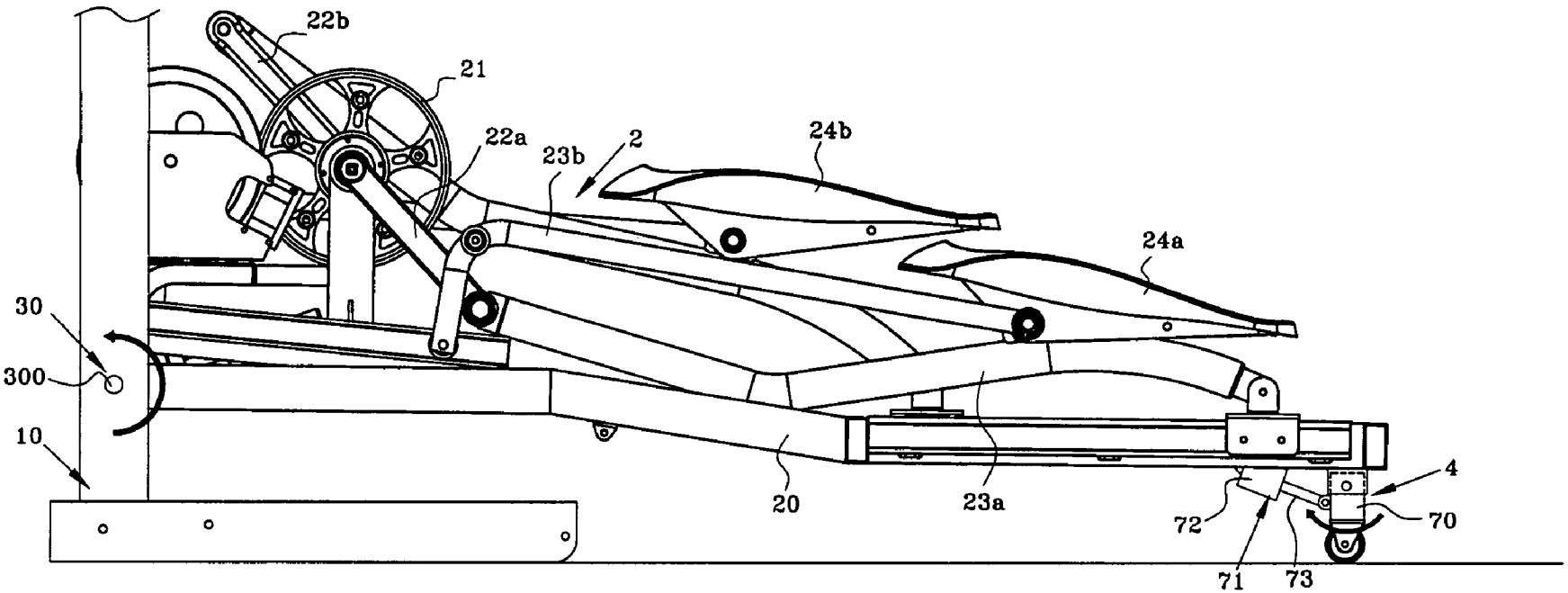
FIG. 2 is a schematic view of a second preferred embodiment of the present invention.
Figure 3:
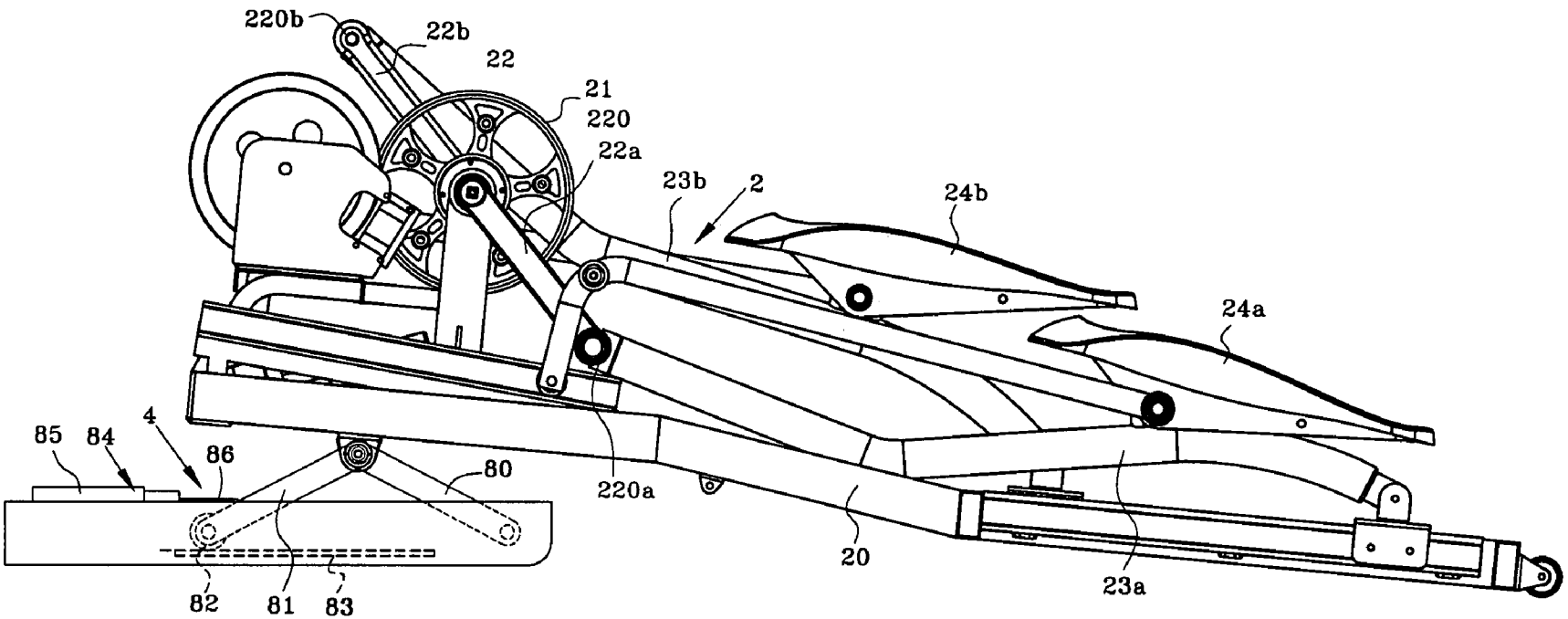
FIG. 3 is a schematic view of a third preferred embodiment of the present invention.

Referring to FIGS. 1 to 3, a foldable elliptic fitness machine according to a preferred embodiment of the present invention comprises a first frame 10, a second frame 20 and an enabling assembly 4 for enabling the second frame 20 to rotate with respect to the first frame 10, wherein the first frame 10 securely supported on a floor and the second frame 20 installed an elliptical structure, and the second frame 20 is pivotally coupled with the first frame 10 by a pivoting device 30, such that the second frame 20 and the elliptical structure 2 can be rotated with respect to the first frame 10 when the enabling assembly 4 actuates, and the first frame 10 stably supports the second frame 20, wherein the elliptical structure 2 is like a general prior art structure comprising a rotating member 22 having two eccentric pivotal point 220*a*, 220*b*, and two pedal arms 23*a*, 23*b*, and a central penetrating axle 220 of the rotating member 22 is pivotally coupled to the second frame 20, and the two pivotal points 220*a*, 220*b* of the rotating member 22 are separately and pivotally coupled to the corresponding first end of a pedal arm 23*a*, 23*b*, and each pedal arm 23*a*, 23*b* includes a footrest 24*a*, 24*b*, such that a user can step on the footrest 24*a*, 24*b*. When the first end of the pedal arm 23*a*, 23*b* rotates with the rotating member 22, the footrest 24*a*, 24*b* can move in an elliptic path. With the foregoing structural design, the elliptical structure 2 of the invention can be changed the level of difficulty of their exercise upright by changing the inclination of the elliptical structure 2 to improve the convenience of using the elliptical fitness machine. In the foregoing basic structure, the rotating member 22 is coaxially coupled with two cranks 22*a*, 22*b* to form a rigid body, and the axle 220 is pivotally coupled onto the second frame 20.

Figure 4:
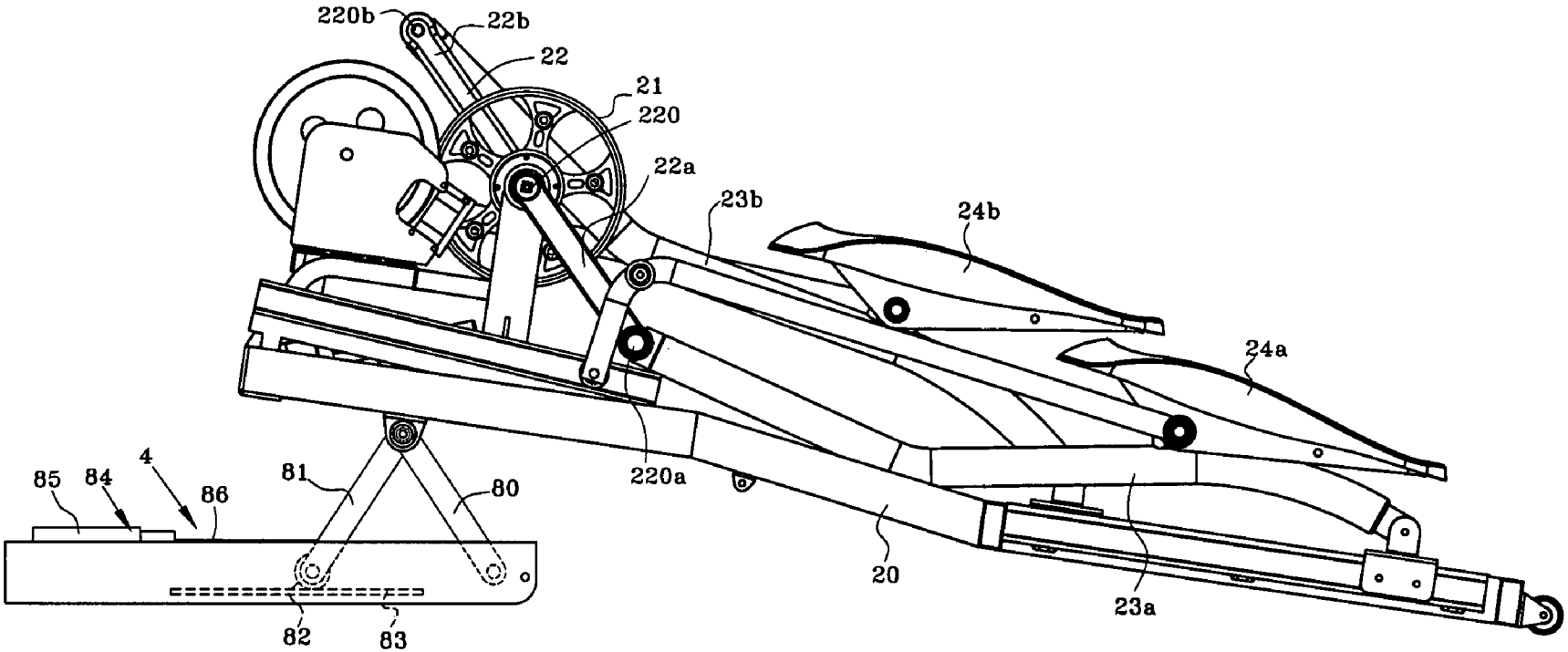
FIG. 4 is a schematic view of a structure as depicted in FIG. 3 which is adjusted to have a larger inclination.
Figure 5:
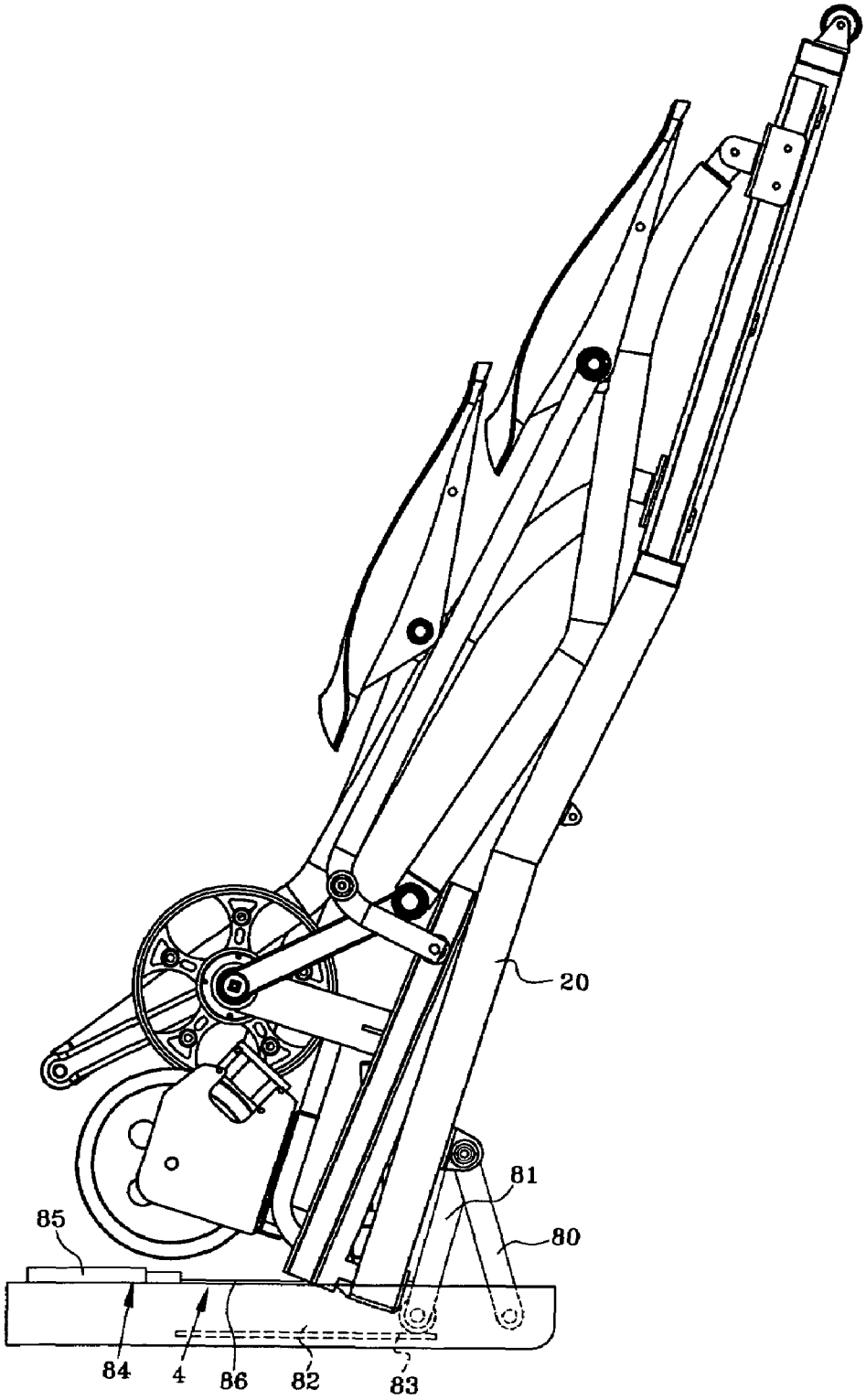
FIG. 5 is a schematic view of a structure as depicted in FIG. 3, which is folded.

The present invention installs a pivoting device 30 for pivotally connecting the second frame 20 with the first frame 10 of the elliptical structure 2. Many preferred embodiments are feasible for the invention and three of them as shown in FIGS. 1 to 3 are used for illustrations. The second preferred embodiment as shown in FIG. 2 can use a simple pivotal axle 300 to pass through the second frame 20 and the first frame 10, such that the second frame 20 can be rotated to an angle with respect to the first frame 10. As to an enabling assembly 4 for enabling the second frame 20 to rotate with respect to the first frame 10, a support rod 70 is pivotally coupled to a rear end of the second frame 20, and an actuating device 71 is connected between the support rod 70 and the second frame 20. The actuating device 71 includes a body 72 and a contractible rod 73, and the contractible rod 73 can be contracted with respect to the body 72, such that the support rod 70 can be swung to an angle to support a rear end of the second frame 20 to define positions of different heights and achieve the function of changing the inclination of the second frame 20. The third preferred embodiment as shown in FIGS. 3 to 5, a link rod 80 and a swinging rod 81 are pivotally coupled to the same pivotal point at the front end of the second frame 20, and another end of the link rod 80 is pivotally coupled to the first frame 10, and a roller 82 is pivotally coupled to a free end of the swinging rod 81, and the first frame 10 includes a track 83, and the roller 82 of the swinging rod 81 is in contact with the track 83, and the enabling assembly 4 has an actuating device 84 connected between the first frame 10 and the swinging rod 81, and the actuating device 84 includes a body 85 and a contractible rod 86, and the contractible rod 86 can be contracted with respect to the body 85, such that the swinging rod 81 is swung to an angle to support the front end of the second frame 20 to define positions of different heights, so as to achieve the function of changing the inclination of the second frame 20.

Figure 6:
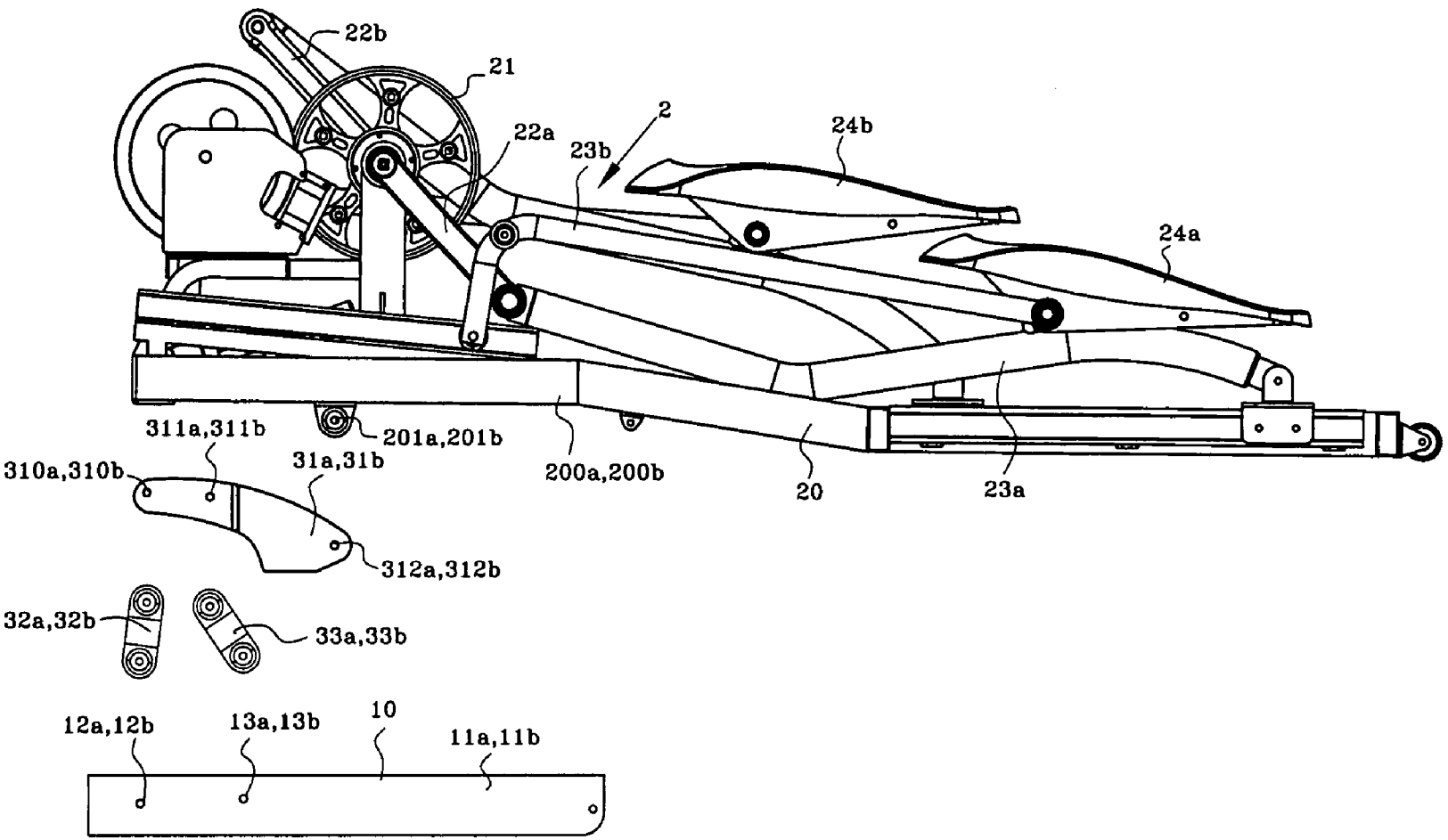
FIG. 6 is an exploded view of a portion of the first preferred embodiment as depicted in FIG. 1.
Figure 7:
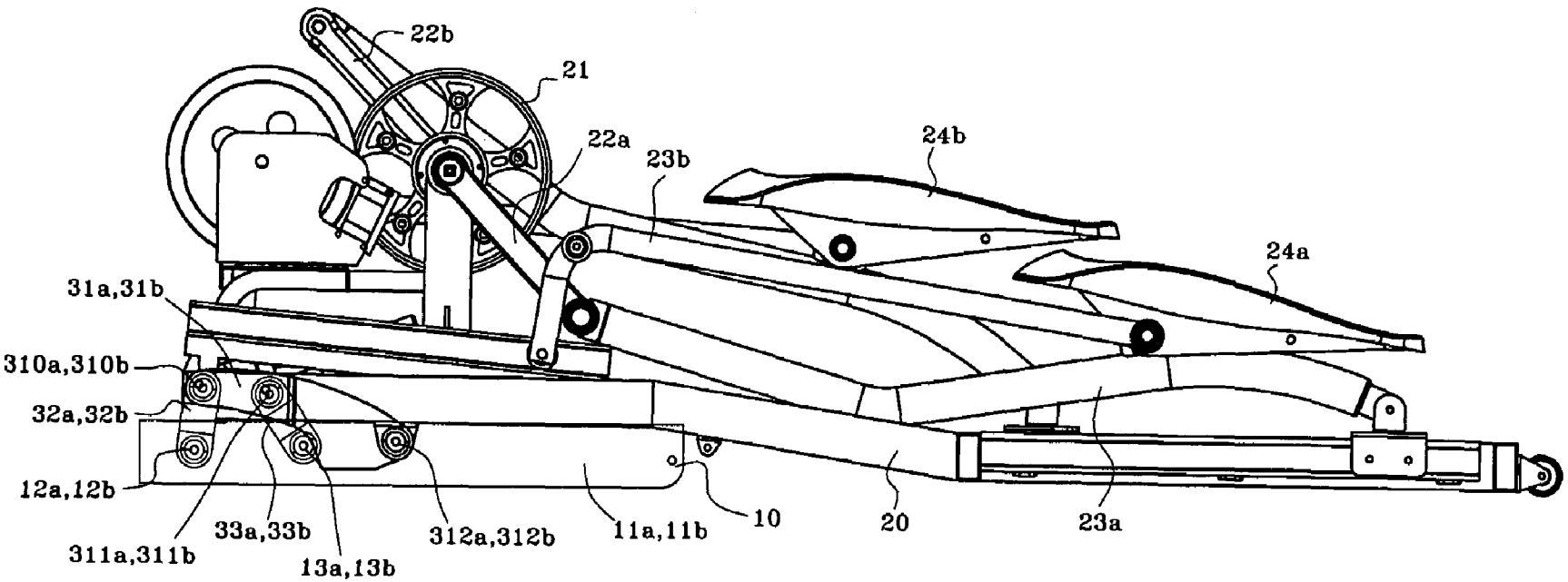
FIG. 7 is a schematic view of an assembled structure as depicted in FIG. 6.
Figure 8:
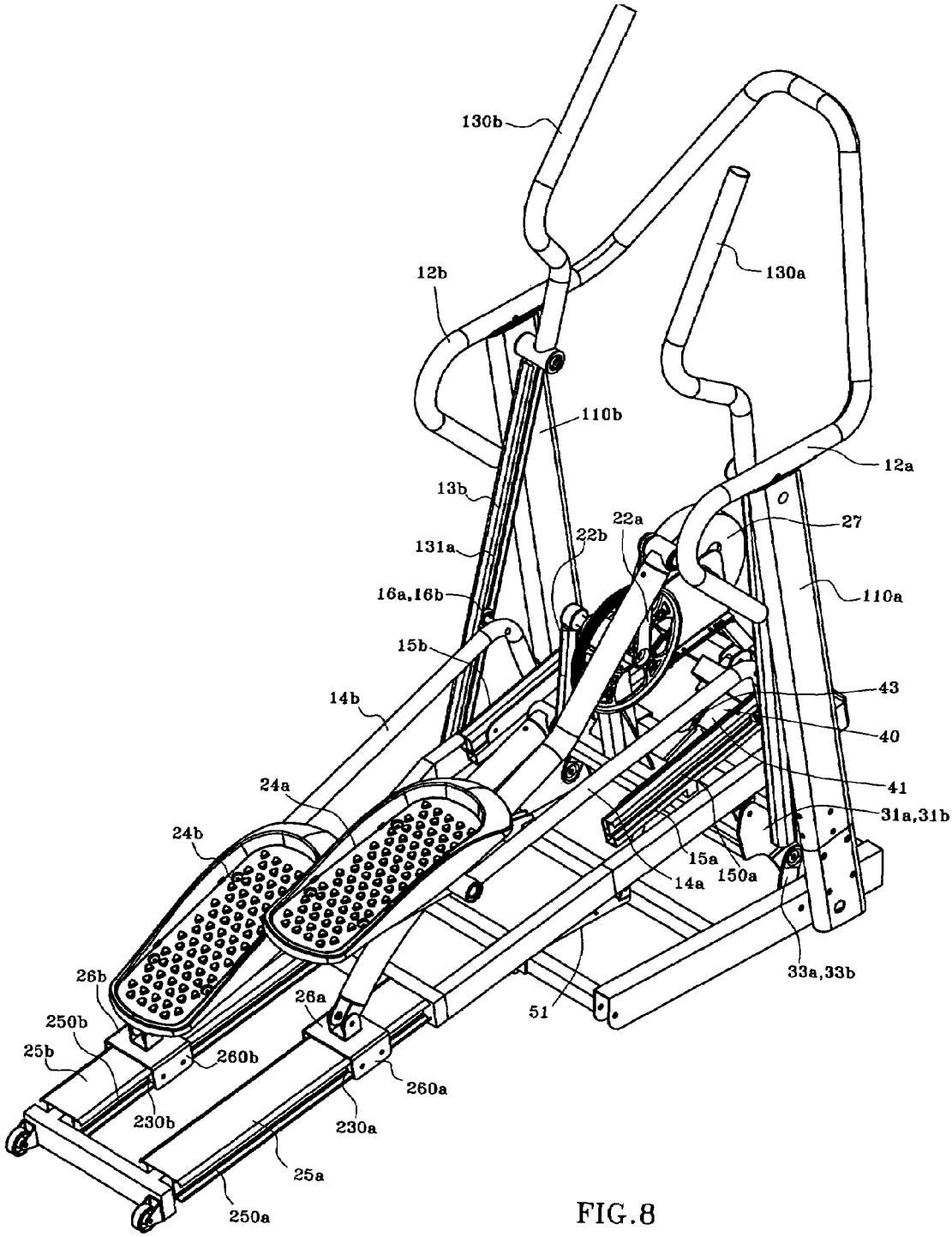
FIG. 8 is a schematic view of a structure as depicted in FIG. 1 which has a larger inclination and a usable status.
Figure 9:
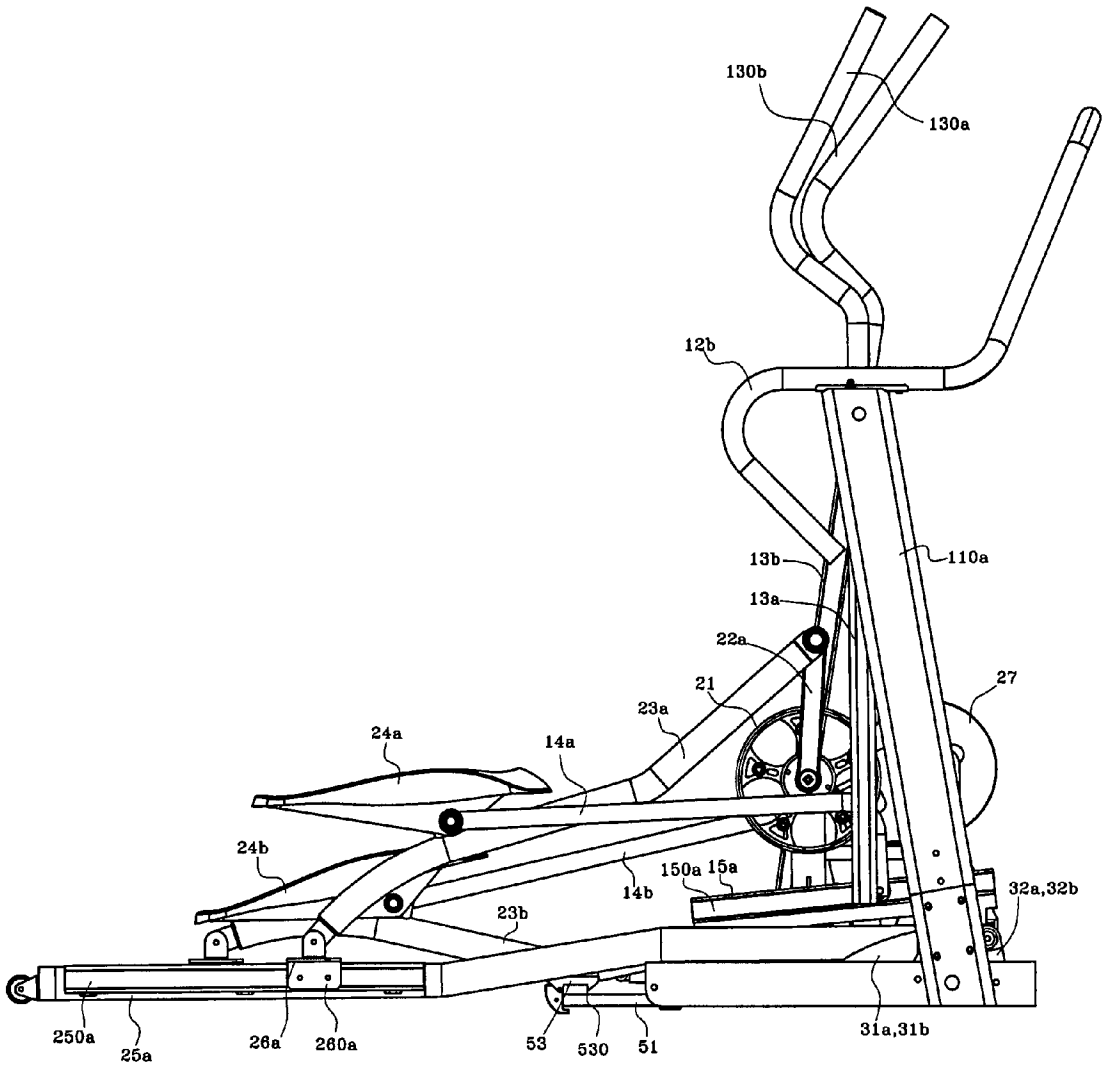
FIG. 9 is a schematic planar diagram of FIG. 1.
Figure 10:
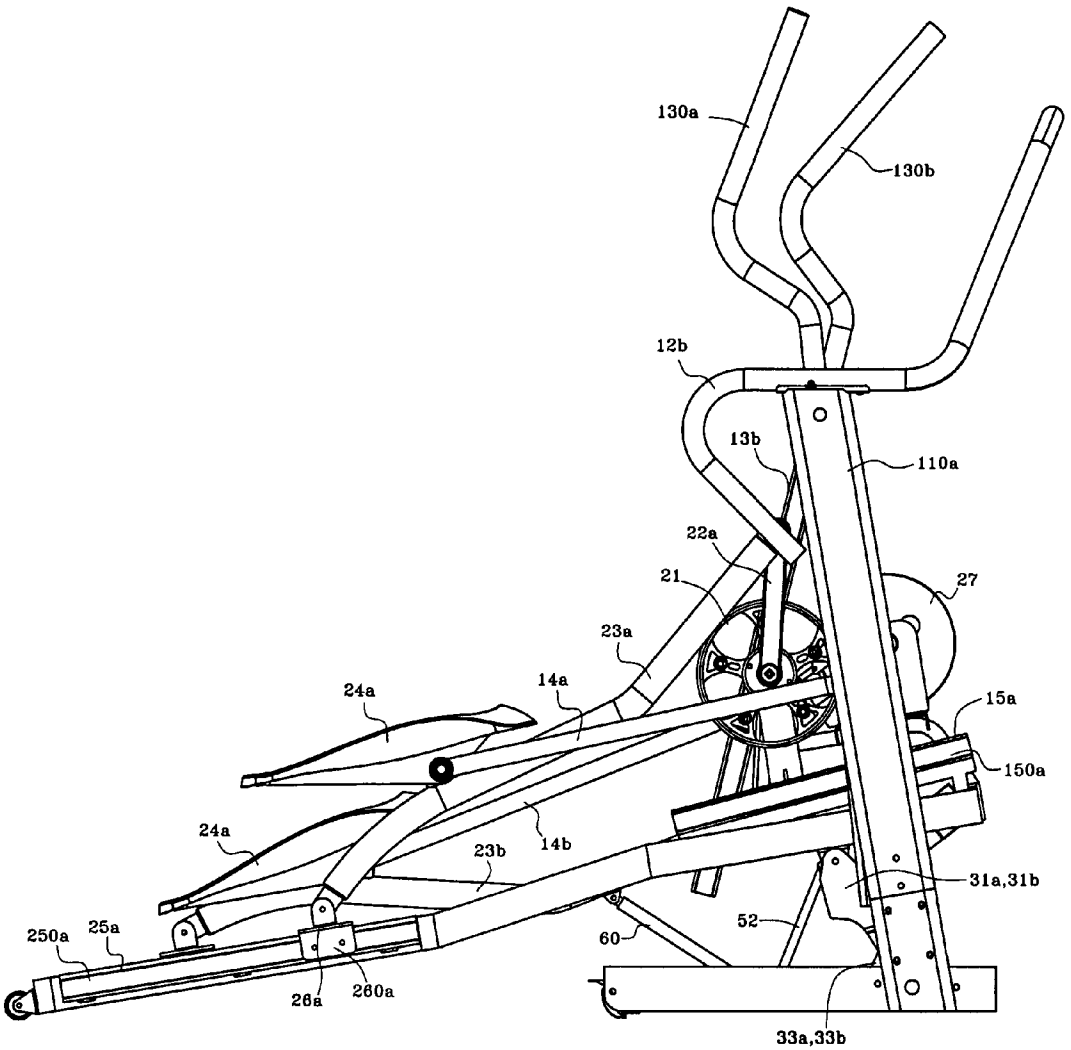
FIG. 10 is a schematic planar diagram of FIG. 8.
Figure 11:
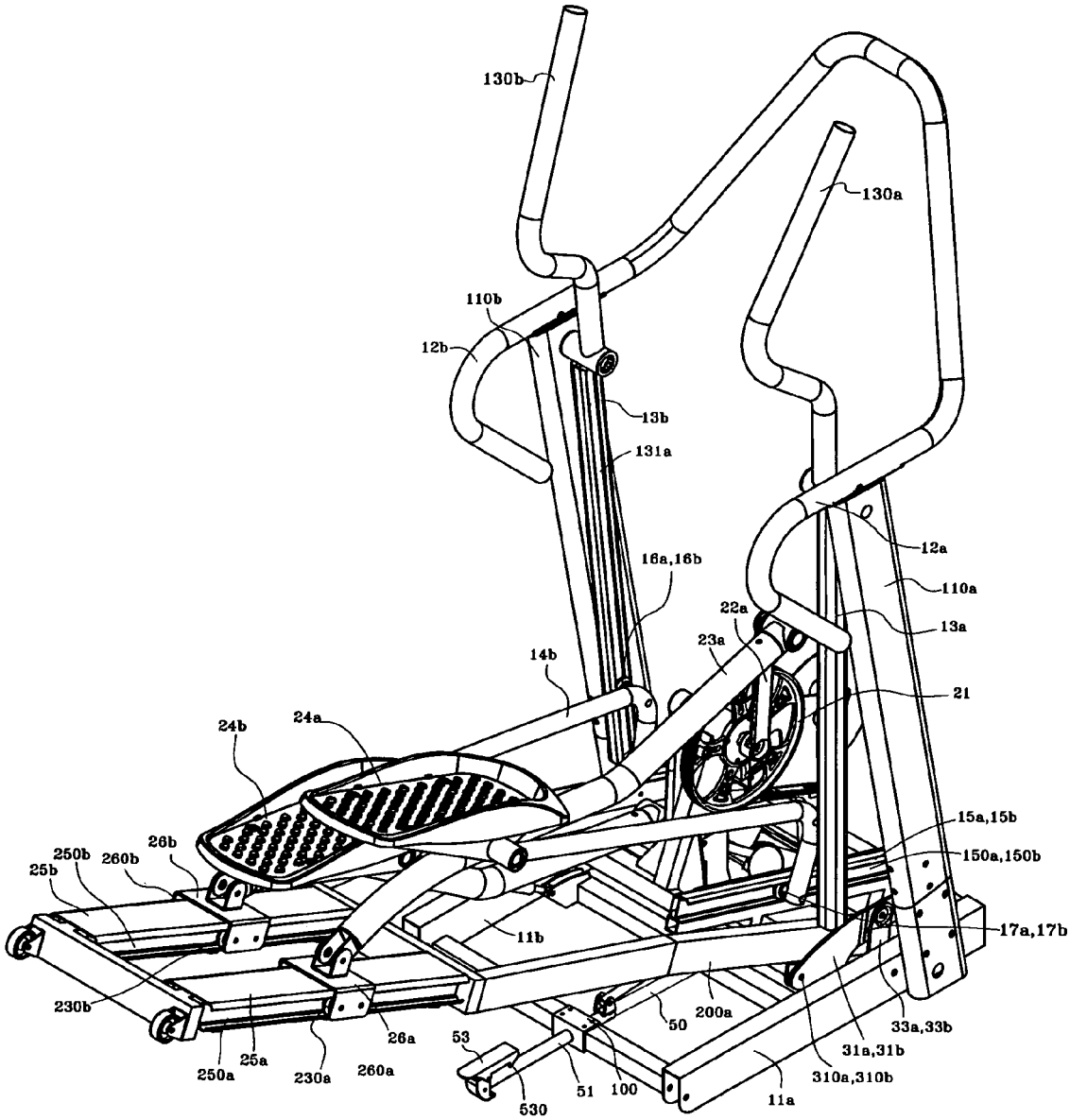
FIG. 11 is a schematic view of a partially folded structure of the present invention.

Since the structure of the present invention includes a structure as illustrated by a complete set of drawings of the first preferred embodiment, therefore the following movements are illustrated by using the first preferred embodiment as shown in FIGS. 1, 6, and 7. The pivoting device 30 according to the first preferred embodiment comprises:

two side panels 11*a*, 11*b*, disposed on a first frame 10, and each of the two side panels 11*a*, 11*b* includes a first pivotal connecting portion 12*a*, 12*b* and a second pivotal connecting portion 13*a*, 13*b*;

two side rods 200*a*, 200*b*, disposed on the second frame 20, and each of the two side rods 200*a*, 200*b* includes a pivotal connecting portion 201*a*, 201*b* proximate to a distal end;

two first link rods 31*a*, 31*b*, and each first link rods 31*a*, 31*b* includes a first pivotal connecting portion 310*a*, 310*b*, a second pivotal connecting portion 311*a*, 311*b* and a third pivotal connecting portion 312*a*, 312*b*, and the third pivotal connecting portion 312*a*, 312*b* on each first link rod 31*a*, 31*b* and a pivotal connecting portion 201*a*, 201*b* corresponding to a side rod 200*a*, 200*b* on the second frame 20 are passed through a pivotal axle (not shown in the figure) for the pivotal connection;

two second link rods 32*a*, 32*b*, and a first end of each second link rod 32*a*, 32*b* is passed through a pivotal axle and pivotally coupled to a first pivotal connecting portion 12*a*, 12*b* corresponding to a side panel 11*a*, 11*b* of the first frame 10, and a second end is passed through a pivotal axle (not shown in the figure) and pivotally coupled to a corresponding first pivotal connecting portion 310*a*, 310*b* of a first link rod 31*a*, 31*b*; and two third link rods 33*a*, 33*b*, and a first end of each third link rod 33*a*, 33*b* is passed through a pivotal axis (not shown in the figure) and pivotally coupled to a second pivotal connecting portion 13*a*, 13*b* corresponding to a side panel 11*a*, 11*b* of the first frame 10, and a second end is passed through a pivotal axle (not shown in the figure) and pivotally coupled to a corresponding second pivotal connecting portion 311*a*, 311*b* of a first link rod 31*a*, 31*b*, wherein the enabling assembly 4 according to a preferred embodiment comprises:

a fixed rod 34, fixed between the two first link rods 31*a*, 31*b* and extended to a lateral side of a connecting rod 35; and an actuating device 40, including a motor 41 for supplying a motive power, and a moving element 42 driven by the motor 41 for moving flexibly, and the moving element 42 is pivotally coupled to the connecting rod 35 of the fixed rod 34;

such that each set of the corresponding first link rod 31*a*, 31*b*, second link rod 32*a*, 32*b*, third link rod 33*a*, 33*b*, and side panel 1*a*, 1*b* constitutes a structure of four link mechanism (11*a*, 31*a*, 32*a*, 33*a*/11*b*, 31*b*, 32*b*, 33*b*).

Since the first link rods 31*a*, 31*b* can be rotated with respect to the second link rod 32*a*, 32*b* and the third link rod 33*a*, 33*b*, and the second link rod 32*a*, 32*b* and the third link rod 33*a*, 33*b* will rotate in opposite directions, and thus the first link rod 31*a*, 31*b* can rotate with respect to the first frame 10, and the second frame 20 is fixed with the first link rods 31*a*, 31*b* by an actuating device 40, such that the second frame 20 and the elliptical structure 2 also can be rotated with respect to the first frame 10 and folded upright. In other words, when the foregoing structure of four link mechanism (11*a*, 31*a*, 32*a*, 33*a*/11*b*, 31*b*, 32*b*, 33*b*) operated with the actuating device 40 and the second frame 20 is secured on a floor, the actuating device 40 is enabled to push or pull the first link rods 31*a*, 31*b* to rotate with respect to the second frame 20, and the first link rod 31*a*, 31*b*, the second link rod 32*a*, 32*b*, and the third link rod 33*a*, 33*b* are operated to ascend or descend the front end of the second frame 20, so as to change the inclination of the second frame 20 (as shown in FIGS. 1, 8, 9, and 10). Further, when the elliptical fitness machine is not in use, the free end at the rear of the second frame 20 is lifted upright, so that the second frame 20 can be rotated and folded upright with respect to the first frame 10 (as shown in FIGS. 1, 6, 7, 11, and 12).

Referring to FIG. 1 for the preferred embodiment of the present invention, an output end of the actuating device 40 is a rotate rod 43 screwed to the moving element 42, such that when the rotate rod 43 is rotated, the moving element 42 can move on the rotate rod 43.

Figure 12:
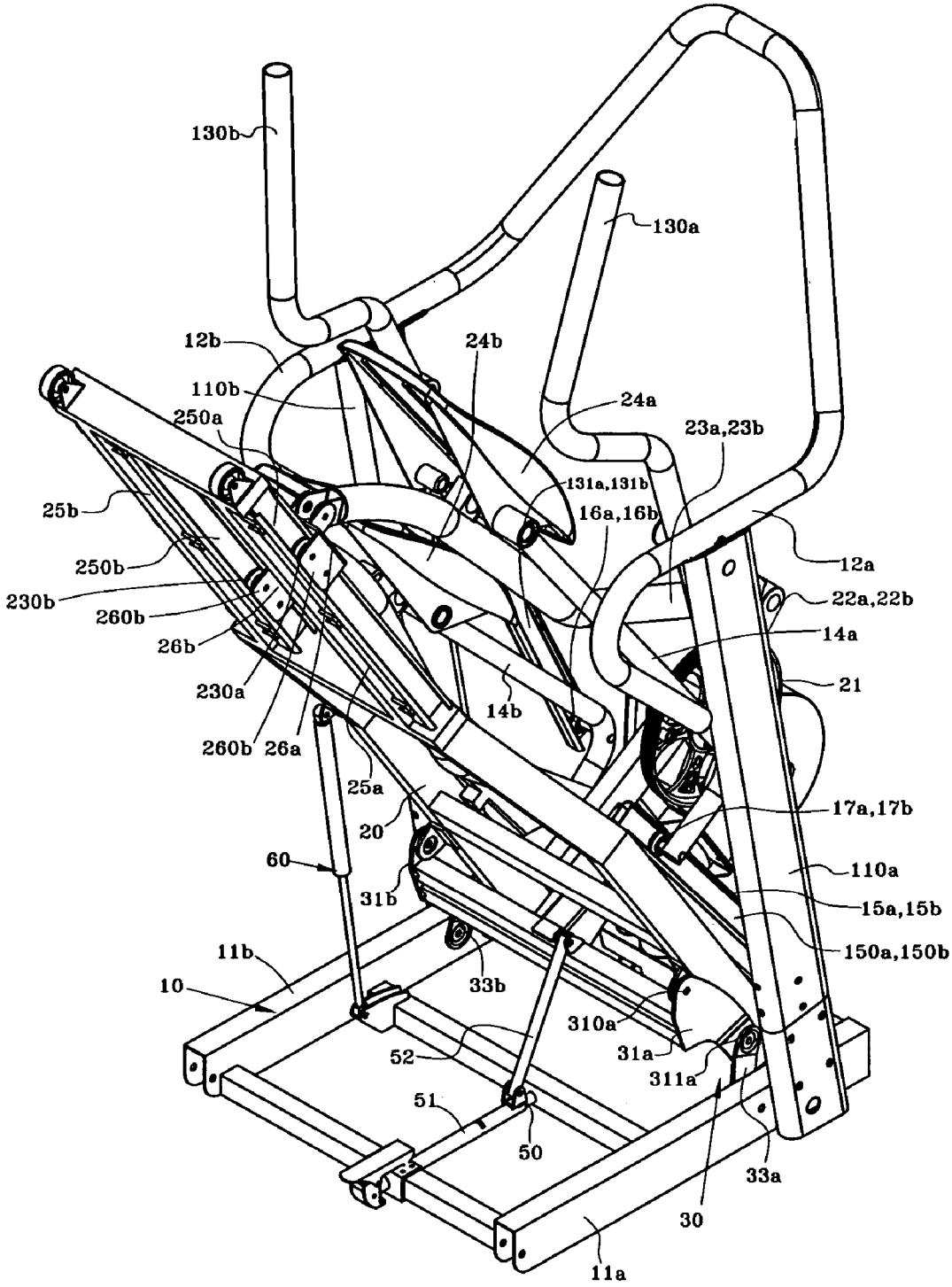
FIG. 12 is a schematic view of a fully folded structure of the present invention.

In FIG. 12, an actuating device 60 is installed and connected between the first frame 10 and the second frame 20 for providing a subsidiary force when the second frame 20 is rotated and folded upright with respect to the first frame 10.

In the elliptical structure on the second frame 20 as shown in FIG. 1, the second frame 20 includes two sliding tracks 25*a*, 25*b*, and the second end of each pedal arm 23*a*, 23*b* includes a roller 230*a*, 230*b*, and the second end of each pedal arm 23*a*, 23*b* is embedded into a corresponding sliding track 25*a*, 25*b*, such that the roller 230*a*, 230*b* can be rolled on the corresponding sliding track 25*a*, 25*b*. In a further preferred embodiment of the present invention, the sliding track 25*a*, 25*b* includes a recessive guide groove 250*a*, 250*b* separately on both sides of the sliding track 25*a*, 25*b*, and the second end of the pedal arm 23*a*, 23*b* is pivotally coupled to a wheel base 26*a*, 26*b*, and each wheel base 26*a*, 26*b* includes a plate 260*a*, 260*b* extended downward from the wheel base 26*a*, 26*b*, and the internal surface of each plate 260*a*, 260*b* is pivotally coupled to two rollers 230*a*, 230*b*, and the roller 230*a*, 230*b* of each plate 260*a*, 260*b* is embedded into a corresponding guide groove 250*a*, 250*b*.

In FIG. 1, the first frame 10 includes a pillar 110*a*, 110*b* extended upward from and disposed separately on both sides of the first frame 10, and each pillar 110*a*, 110*b* includes a handgrip 12*a*, 12*b*.

In FIG. 1, the first frame 10 includes a pillar 110*a*, 110*b* extended upward from and disposed on both sides of the first frame 10, and each pillar 110*a*, 110*b* is pivotally to a shaking rod 13*a*, 13*b* extended vertically up and down, and each pedal arm 23*a*, 23*b* of the second frame 20 is pivotally to the first end of a link rod 14*a*, 14*b*, and the second end of the link rod 14*a*, 14*b* is coupled to the bottom of a corresponding shaking rod 13*a*, 13*b*, and the top of each shaking rod 13*a*, 13*b* has a handle 130*a*, 130*b*. In a further preferred embodiment, the lower half of each shaking rod 13*a*, 13*b* includes a C-shape cross section extended along the shaking rod 13*a*, 13*b* to the first guide groove 131*a*, 131*b*, and the second frame 20 includes two corresponding link rods 14*a*, 14*b* separately installed in a guide track 15*a*, 15*b*, and each lateral side of the guide track 15*a*, 15*b* has a C-shape cross section extended axially along the first guide track 15*a*, 15*b* to the second guide groove 150*a*, 150*b*, and each link rod 14*a*, 14*b* includes a first roller 16*a*, 16*b* and a second roller 17*a*, 17*b* separately disposed proximate to the ends of the link rod 14*a*, 14*b*. The first roller 16*a*, 16*b* is embedded and limited in the corresponding first guide groove 131*a*, 131*b* and rolled in the first guide groove 131*a*, 131*b*, and the second roller 17*a*, 17*b* is embedded and limited in the corresponding second guide groove 150*a*, 150*b* and rolled in the second guide groove 150*a*, 150*b*. With such design, the second frame 20 can be rotated and folded upright with respect to the first frame 10 to avoid any interference to the shaking rod 13*a*, 13*b* and the second frame 20.

Figure 13:
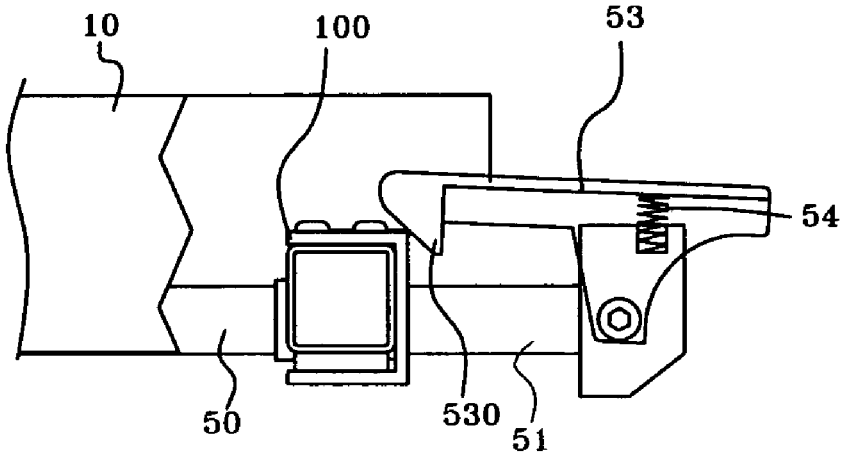
FIG. 13 is a schematic view of a fourth preferred embodiment of the present invention.
Figure 14:
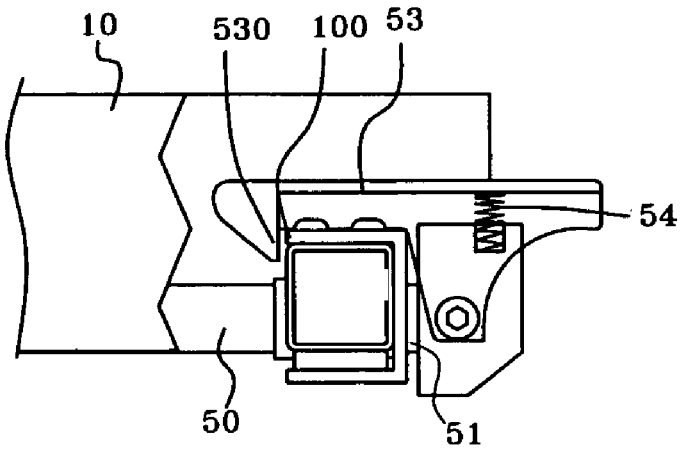
FIG. 14 is a schematic view of the movements with respect to FIG. 13.

Referring to FIGS. 1, 13, 14 for a preferred embodiment of the present invention, the first frame 10 further comprises a sliding track 50, and the axis of the sliding track 50 is extended along the direction of the front and rear ends of the first frame 10, and the sliding track 50 is sheathed onto a sliding rod 51, and the sliding rod 51 can be moved and contracted with respect to the sliding track 50. The sliding rod 51 includes a second pivotal connecting portion 510 pivotally coupled to a first end of a link rod 52, and the second end of the link rod 52 is pivotally coupled to the second frame 20. The sliding rod 51 includes a latch 53 pivotally coupled thereon, and a first end of the latch 53 includes a hook portion 530, and a spring 54 is installed between the second end of the latch 53 and the sliding rod 51. The first frame 10 includes a hooked portion 100 corresponding to the hook portion 530 of the latch 53, such that when the second frame 20 is rotated and folded upright with respect to the first frame 10, the sliding rod 51 is contracted with respect to the sliding track 50, and the hook portion 530 of the latch 53 will be hooked and fixed to the hooked portion 100 of the first frame 10, such that the second frame 20 is securely fixed and supported with respect to the first frame 10. If the second frame 20 is set down for the use of the elliptical fitness machine, the sliding rod 51 will be linked and extended backward to increase the area of the supporting plane to give a better stability when a user is doing exercises on the second frame 20.

In FIG. 1, the second frame further includes a flywheel 21 pivotally coupled thereon, and the flywheel 21 and the rotating member 22 are coaxially and pivotally coupled to the second frame 20, and the flywheel 21 includes a magnetic resisting device 27, such that when the flywheel 21 rotates, the magnetic lines of the magnet on the magnetic resisting device 27 is cut off, and the flywheel 21 produces a magnetic resistance to improve the exercise performance.

Figure 15:
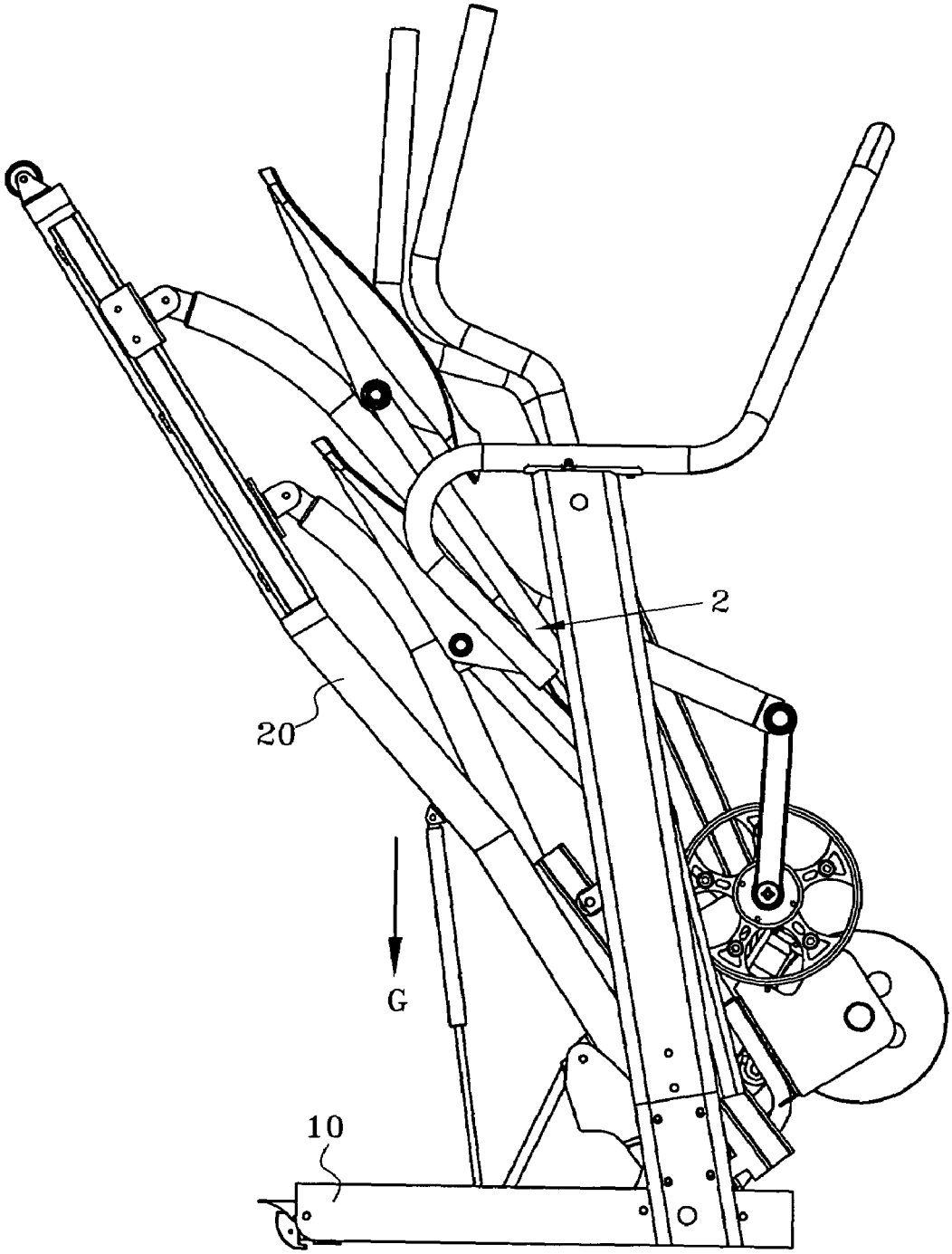
FIG. 15 is a schematic view of a second frame together with an elliptical structure being folded upright according to the present invention.

In FIG. 15, the bottom of the first frame 10 supported on a floor constitutes a supporting plane. When the second frame 20 with the elliptical structure 2 is folded fully upright with respect to the first frame 10, the second frame 20 and the elliptical structure 2 have a center of gravity G falling within the range of the supporting plane of the first frame 10.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An elliptical fitness machine having inclination adjusting mechanism comprises: a first frame, a second frame supported by the first frame, and an enabling assembly for enabling the second frame to rotate with respect to the first frame, wherein the first frame securely supported on a floor and the second frame mounted with an elliptical structure, and the second frame pivotally coupled to the first frame by a pivotal axle, such that the second frame and the elliptical structure can be rotated with respect to the first frame to change the inclination of the second frame when the enabling assembly actuates, wherein the enabling assembly including a support rod and an actuating device, the support rod pivotally coupled to the rear end of the second frame, and the actuating device coupled between the support rod and the second frame, and the actuating device including a body and a contractible rod, and the contractible rod can be contracted with respect to the body to swing the support rod to an angle, and wherein the elliptical structure comprising a rotating member coaxially coupled to two cranks to define a rigid body corresponding to an axle, and two pedal arms, and the middle of the rotating member and the two cranks pivotally coupled with the second frame by the axle, each crank having an eccentric pivotal point, each pivotal point of each crank pivotally coupled to a first end of one corresponding pedal arm, and each pedal arm including a footrest capable of moving in an elliptic path.

2. The elliptical fitness machine as claimed in claim 1, wherein the second frame includes two sliding tracks, and a second end of the two pedal arms separately have a roller, and a second end of the each pedal arm is embedded into the sliding track, such that the roller can roll on the corresponding sliding track.

3. An elliptical fitness machine having inclination adjusting mechanism comprises: a first frame, a second frame supported by the first frame, and an enabling assembly for enabling the second frame to rotate with respect to the first frame, wherein the first frame securely supported on a floor and the second frame mounted with an elliptical structure, and the second frame pivotally coupled to the first frame by a pivoting device, such that the second frame and the elliptical structure can be rotated with respect to the first frame to change the inclination of the second frame when the enabling assembly actuates, wherein the pivoting device pivotally coupled to a link rod and a swinging rod at the same pivotal point at the front end of the second frame, another end of the link rod pivotally coupled to the first frame, the swinging rod including a roller pivotally coupled to a free end of the swinging rod, the first frame having a track thereon, the roller of the swinging rod being in contact with the track, the enabling assembly connected between the swinging rod and the first frame, the enabling assembly including an actuating device connected between the first frame and the swinging rod, the actuating device including a body and a contractible rod, and the contractible rod can be contracted with respect to the body to swing the swinging rod to an angle, and wherein the elliptical structure comprising a rotating member coaxially coupled to two cranks to define a rigid body corresponding to an axle, and two pedal arms, and the middle of the rotating member and the two cranks pivotally coupled with the second frame by the axle, each crank having an eccentric pivotal point, each pivotal point of the each crank pivotally coupled to a first end of one corresponding pedal arm, and each pedal arm including a footrest capable of moving in an elliptic path.

4. The elliptical fitness machine as claimed in claim 3, wherein the second frame includes two sliding tracks, and a second end of the two pedal arms separately have a roller, and a second end of the each pedal arm is embedded into the sliding track, such that the roller can roll on the corresponding sliding track.

5. The elliptical fitness machine as claimed in claim 4, wherein the sliding track includes a recessive guide groove disposed separately on both sides of the sliding track, and a second end of the pedal arm is pivotally coupled to a wheel base, and the wheel base includes a plate extended down separately from both sides of the wheel base, and the internal surface of the each plate is pivotally coupled to two of the rollers, and the roller of the each plate is embedded in the corresponding guide groove.

6. The elliptical fitness machine as claimed in claim 3, wherein the first frame includes a pillar extended downward separately from both sides of the first frame, and the each pillar includes a handgrip.

7. The elliptical fitness machine as claimed in claim 3, wherein the first frame includes a pillar extended upward separately from both sides of the first frame, and the each pillar is pivotally coupled to a shaking rod extended vertically up and down, and the each pedal arm on the second frame is pivotally coupled to a first end of a link rod, and a second end of the each link rod is coupled to the bottom of a corresponding shaking rod, and the each shaking rod includes a handle at the top of the shaking rod.

8. The elliptical fitness machine as claimed in claim 7, wherein the each shaking rod includes a C-shape cross section disposed at its lower half and a first guide groove extended axially along the shaking rod, and the second frame includes a guide track disposed separately on the two link rods, and the each guide track includes a C-shape cross section at a lateral side of the guide track and a second guide groove extended axially along the guide track, and the each link rod includes a first roller and a second roller disposed separately on the distal ends of the link rod, and the first roller is embedded and limited in the corresponding first guide groove and rolled in the first guide groove, and the second roller is embedded and limited in the corresponding second guide groove and rolled in the second guide groove.

9. The elliptical fitness machine as claimed in claim 3, wherein the first frame further comprising a sliding track, and the axial line of the sliding track is extended along the direction of the front and rear ends of the first frame, and the sliding track is sheathed onto the sliding rod, such that the sliding rod can move with respect to the sliding track for a contraction, and the sliding rod includes a second pivotal connecting portion, and the second pivotal connecting portion is pivotally coupled to a first end of a link rod, and the link rod second end is pivotally coupled to the second frame, and the sliding rod includes a latch pivotally coupled thereon, and a first end of the latch includes a hook portion, and a spring is installed between a second end of the latch and the sliding rod, and the first frame includes a hooked portion corresponding to the hook portion of the latch, such that when the second frame is rotated and folded upright with respect to the first frame, the sliding rod is contracted with respect to the sliding track, and the hook portion of the latch is hooked and fixed by the hooked portion of the first frame for fixing the second frame with the corresponding first frame.

10. The elliptical fitness machine as claimed in claim 3, wherein the second frame further comprises a flywheel, and the flywheel and the rotating member are coaxially and pivotally coupled to the second frame, and the flywheel includes a magnetic resisting device, such that when the flywheel is rotated to cut off a magnetic line of a magnet on the magnetic resisting device, the flywheel produces a magnetic resistance.

11. An elliptical fitness machine having inclination adjusting mechanism comprises a first frame, a second frame supported by the first frame, and an enabling assembly for enabling the second frame to rotate with respect to the first frame, the first frame securely supported on a floor and the second frame mounted with an elliptical structure, and the second frame pivotally coupled to the first frame by a pivoting device, such that the second frame and the elliptical structure can be rotated with respect to the first frame when the enabling assembly actuates, wherein the pivoting device comprising:

two side panels, disposed at the first frame, each side panel including a first pivotal connecting portion and a second pivotal connecting portion;

two side rods, disposed at the second frame, and each side rod including a pivotal connecting portion disposed proximate to an end of the second frame;

two first link rods, each having a first pivotal connecting portion, a second pivotal connecting portion, and a third pivotal connecting portion, and the third pivotal connecting portion on the each first link rod and the pivotal connecting portion corresponding to the rod on the second frame passed by a pivotal axle for defining a pivotal connection;

two second link rod, and a first end of the each second link rod having a pivotal axle and pivotally coupled to a first pivotal connecting portion corresponding to the side panel of the first frame, and the second end including a pivotal axle pivotally coupled to a corresponding first pivotal connecting portion of the first link rod; and two third link rods, and a first end of the each third link rod including a pivotal axle pivotally coupled to a second pivotal connecting portion corresponding to the side panel of the first frame, and a second end including a pivotal axle pivotally coupled to the second pivotal connecting portion corresponding to the first link rod; and wherein the enabling assembly comprising:

a fixed rod, fixed to the two first link rods, and a lateral side of the fixed rod extended to a connecting rod; and an actuating device including a motor and a moving element driven by the motor to move and contract, and the moving element pivotally coupled to the connecting rod of the fixed rod;

each set of the first link rod, the second link rod, the third link rod, and the side panel constitutes a structure of four link mechanism, such that when the actuating device drives the moving element, the structure of four link mechanism will move to drive an end of the second frame to ascend to change the inclination of the second frame.

12. The elliptical fitness machine as claimed in claim 11, wherein the second link rod and the third link rod are rotated in opposite directions with respect to the first frame.

13. The elliptical fitness machine as claimed in claim 11, wherein the actuating device has an output end being a rotate rod, and the rotate rod is screwed with the moving element, such that when the rotate rod is rotated, the moving element can move on the rotate rod.

14. The elliptical fitness machine as claimed in claim 11, wherein the second frame includes two sliding tracks, and a second end of the two pedal arms separately have a roller, and a second end of the each pedal arm is embedded into the sliding track, such that the roller can roll on the corresponding sliding track.

15. The elliptical fitness machine as claimed in claim 14, wherein the sliding track includes a recessive guide groove disposed separately on both sides of the sliding track, and a second end of the pedal arm is pivotally coupled to a wheel base, and the wheel base includes a plate extended down separately from both sides of the wheel base, and the internal surface of the each plate is pivotally coupled to two of the rollers, and the roller of the each plate is embedded in the corresponding guide groove.

16. The elliptical fitness machine as claimed in claim 11, wherein the first frame includes a pillar extended downward separately from both sides of the first frame, and the each pillar includes a handgrip.

17. The elliptical fitness machine as claimed in claim 11, wherein the first frame includes a pillar extended upward separately from both sides of the first frame, and the each pillar is pivotally coupled to a shaking rod extended vertically up and down, and the each pedal arm on the second frame is pivotally coupled to a first end of a link rod, and a second end of the each link rod is coupled to the bottom of a corresponding shaking rod, and the each shaking rod includes a handle at the top of the shaking rod.

18. The elliptical fitness machine as claimed in claim 17, wherein the each shaking rod includes a C-shape cross section disposed at its lower half and a first guide groove extended axially along the shaking rod, and the second frame includes a guide track disposed separately on the two link rods, and the each guide track includes a C-shape cross section at a lateral side of the guide track and a second guide groove extended axially along the guide track, and the each link rod includes a first roller and a second roller disposed separately on the distal ends of the link rod, and the first roller is embedded and limited in the corresponding first guide groove and rolled in the first guide groove, and the second roller is embedded and limited in the corresponding second guide groove and rolled in the second guide groove.

19. The elliptical fitness machine as claimed in claim 11, wherein the first frame further comprising a sliding track, and the axial line of the sliding track is extended along the direction of the front and rear ends of the first frame, and the sliding track is sheathed onto the sliding rod, such that the sliding rod can move with respect to the sliding track for a contraction, and the sliding rod includes a second pivotal connecting portion, and the second pivotal connecting portion is pivotally coupled to a first end of a link rod, and the link rod second end is pivotally coupled to the second frame, and the sliding rod includes a latch pivotally coupled thereon, and a first end of the latch includes a hook portion, and a spring is installed between a second end of the latch and the sliding rod, and the first frame includes a hooked portion corresponding to the hook portion of the latch, such that when the second frame is rotated and folded upright with respect to the first frame, the sliding rod is contracted with respect to the sliding track, and the hook portion of the latch is hooked and fixed by the hooked portion of the first frame for fixing the second frame with the corresponding first frame.

20. The elliptical fitness machine as claimed in claim 11, wherein the second frame further comprises a flywheel, and the flywheel and the rotating member are coaxially and pivotally coupled to the second frame, and the flywheel includes a magnetic resisting device, such that when the flywheel is rotated to cut off a magnetic line of a magnet on the magnetic resisting device, the flywheel produces a magnetic resistance.

* * * * *